US005941518A

United States Patent [19]

Sokac et al.

[11] Patent Number: 5,941,518

[45] Date of Patent: Aug. 24, 1999

[54] SHEET FEEDER WITH VARIABLE LENGTH, VARIABLE SPEED SHEETPATH

[75] Inventors: Russell J. Sokac, Rochester; Kathleen M. Martin; Michael J. Martin, both of Hamlin; Lloyd W. Durfey, Palmyra, all of N.Y.

[73] Assignee: Xerox Corporation, Stamford, Conn.

[21] Appl. No.: 08/354,387

[22] Filed: Dec. 12, 1994

[51] Int. Cl.[6] ..... B65H 5/34

[52] U.S. Cl. ..... 271/10.05; 271/10.08; 271/270

[58] Field of Search ..... 271/10.02, 10.03, 271/10.05, 10.08, 10.11, 34, 110, 111, 117, 270; 221/244; 193/30

[56] References Cited

U.S. PATENT DOCUMENTS

| | | | |
|---|---|---|---|
| 760,402 | 5/1904 | Scott | 221/244 |
| 4,702,466 | 10/1987 | DuBois | 271/110 X |
| 5,050,859 | 9/1991 | Paxon | 271/270 |
| 5,101,241 | 3/1992 | Watanabe | 355/323 |
| 5,146,286 | 9/1992 | Rees et al. | 355/309 |

*Primary Examiner*—F. J. Bartuska
*Attorney, Agent, or Firm*—Kevin R. Kepner

[57] ABSTRACT

A floating feedhead having a variable sheetpath for an electrophotographic printing machine. A feeder for feeding sheets from the top of a stack to a processor for a printing machine is disclosed. The feedhead is of a standard retard feed type having either a nudger roll/feed roll or a feed belt in combination with a retard member to separate sheets. The feedhead is connected to the sheet delivery area of the machine by a variable length, variable speed sheetpath. The sheetpath has a drive member such as a drive nip in cooperation with the feedhead. When the sheetpath is at its longest the feedhead and variable drive member operate at a higher speed to deliver the sheets to the sheet intake area at a predetermined time interval. As sheets are fed and the sheetpath becomes shorter, the variable drive and feedhead slow to maintain proper sheet timing. The sheetpath may be of a telescopic baffle configuration or could alternatively be a variable speed vertical transport arrangement.

2 Claims, 2 Drawing Sheets

SHEET FEEDER WITH VARIABLE LENGTH, VARIABLE SPEED SHEETPATH

This invention relates generally to a sheet feeder, and more particularly concerns a sheet feeder with a variable length, variable speed sheetpath for use with electrophotographic printing machines.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, sheet feeders having a high capacity are utilized to supply sheets to the machine processor. Generally these sheet stacks are supported on an elevator mechanism for supply to a fixed feedhead. The feedhead then forwards individual sheets along a fixed input path in a timed relation to the printing processor. These elevator mechanisms require a relatively high power motor to drive the sheet stack to the feedhead.

It is desirable to have a feeder device in which the sheet stack remains fixed and the feedhead moves as the sheet stack is depleted. However, when a feedhead is not fixed the length of the input path from the feedhead to the processor must be variable and the timing must then be corrected for the sheets as the path length changes. It is therefore desirable to have a variable length, variable speed sheetpath to maintain the proper timed relationship between sheets as the sheet stack is depleted.

The following disclosures may be relevant to various aspects of the present invention:

U.S. Pat. No. 5,146,286

Patentee: Rees et al.

Issue Date Sep. 8, 1992

U.S. Pat. No. 5,101,241

Patentee: Watanabe

Issue Date: Mar. 31, 1992

The relevant portions of the foregoing disclosures may be briefly summarized as follows:

U.S. Pat. No. 5,146,286 describes a device in which sheets are fed and stacked in the same device. A feeder having a fixed stacking tray is used with a floating feedhead in which the feedhead is connected to a stacking tray above the loading tray. As a sheet stack is depleted the finished sheets are discharged onto a stacking tray immediately above the sheet holding tray for an efficient use of space.

U.S. Pat. No. 5,101,241 discloses a sorter having an assortment of trays for receiving sheets. Sheets are directed to each tray by a moveable sheetpath from a processor to each tray.

In accordance with one aspect of the present invention, there is provided a sheet feeding apparatus. The apparatus comprises a fixed support for supporting a stack of sheets, a movable feedhead contacting the stack of sheets and a variable length sheetpath between said feedhead and a sheet delivery area.

Pursuant to another aspect of the present invention, there is provided An electrophotographic printing machine having a sheet feeding apparatus for feeding cut sheets in timed relationship into a sheet processor, comprising a fixed support for supporting a stack of sheets, a movable feedhead contacting the stack of sheets and a variable length sheetpath between said feedhead and a sheet delivery area.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
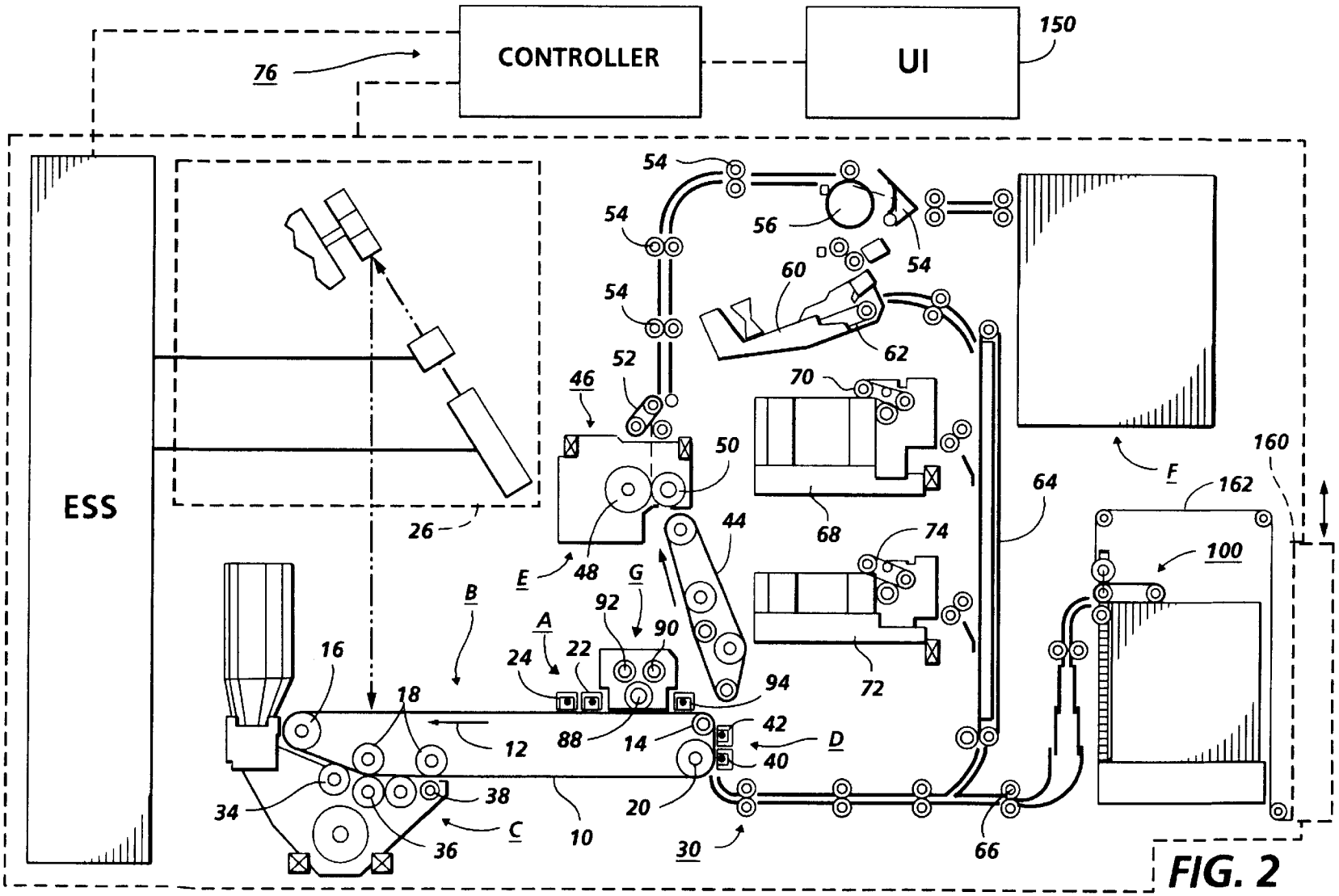
FIG. 2 is a schematic elevational view of an electrophotographic printing machine including the high capacity variable length, variable speed sheetpath feeder of the present invention therein.

For a general understanding of the features of the present invention, reference is made to the drawings. In the drawings, like reference numerals have been used throughout to identify identical elements. FIG. 2 schematically depicts an electrophotographic printing machine incorporating the features of the present invention therein. It will become evident from the following discussion that the sheet feeder of the present invention may be employed in a wide variety of devices and is not specifically limited in its application to the particular embodiment depicted herein.

Referring to FIG. 2 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar™. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated generally by the reference numeral 30, records an electrostatic latent image on the photoconductive surface of the belt 10. Imaging module 30 includes a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Here, the imaging module 30 (ROS) includes a laser 110 for generating a collimated beam of monochromatic radiation 120, an electronic subsystem (ESS), located in the machine electronic printing controller 100 that transmits a set of signals via 114 corresponding to a series of pixels to the laser 110 and/or modulator 112, a modulator and beam shaping optics unit 112, which modulates the beam 120 in accordance with the image information received from the ESS, and a rotatable polygon 118 having mirror facets for sweep deflecting the beam 122 into raster scan lines which sequentially expose the surface of the belt 10 at imaging station B.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets are attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 facedown on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Secondary tray 68 and auxiliary tray 72 are secondary sources of copy sheets. The high capacity variable sheetpath sheet feeder of the present invention, indicated generally by the reference numeral 100, is the primary source of copy sheets. Further details of the operation of sheet feeder 100 will be described hereinafter with reference to FIGS. 1A and 1B of the drawings. The variable speed, variable length path described herein is also applicable to and can be used on secondary feed trays 68 and 72.

The various machine functions are regulated by controller 76. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 1A:
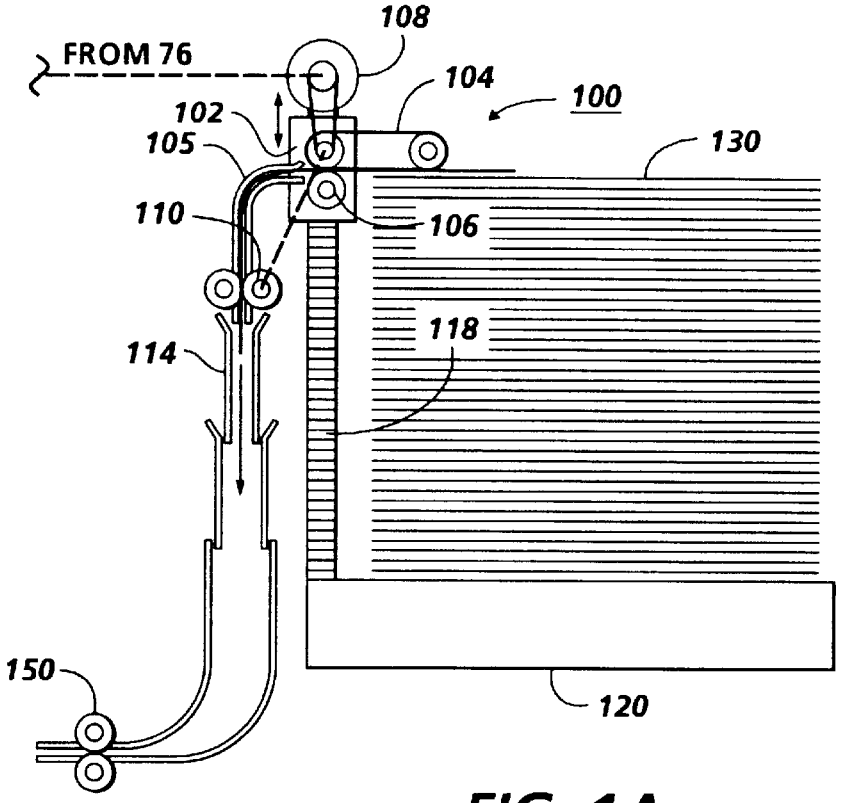
FIGS. 1A and 1B are schematic elevational views of the floating feeder with variable length sheetpath of the present invention.
Figure 1B:
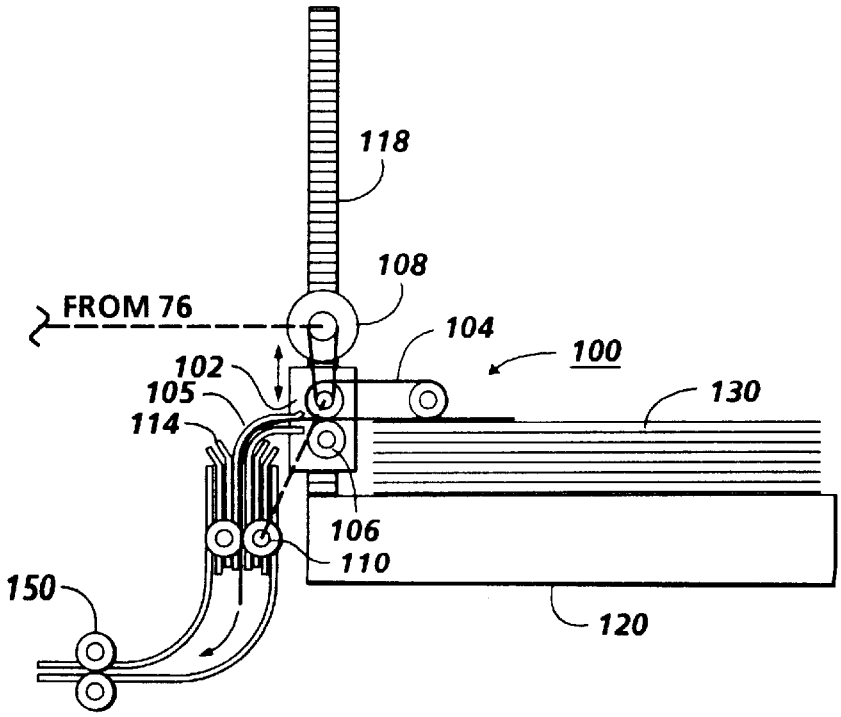

Turning now to FIGS. 1A and 1B there is illustrated a isolated schematic diagram of the floating feed head of the present invention.

Turning first to FIG. 1A it can be seen that the paper stack 130 is loaded into the stationary paper tray 120 in the machine. A floating feed head 102, usually of the retard feed type is located at the top edge of the stack 130. The feedhead is on a standard retard feed type having either a nudger roll/feed roll or as illustrated, a feed belt 104 in combination with a retard member 106 to separate sheets. The feedhead 102 is connected to the sheet delivery area of the machine by a variable length, variable speed sheetpath 114. There is a baffle 105 leading from the feed head 102 to the paper take away rolls 110 leading to the acquisition rolls 150 in the paper path of the machine processor. The take away rolls 110 are coordinated with the feed head 102 so that they operate to transport the sheet from the feed head 102 to the acquisition rolls 150 within a prescribed time period.

Turning next to FIG. 1B, the same paper tray 120 is illustrated with the stack 130 considerably depleted. Once again, the feed head 102 as illustrated as are the take away rolls 110 and the telescopic baffle 114. It can be seen that the baffle has now retracted and the total paper path length from the feed head 102 to the acquisition rolls 150 is much shorter. The controller 76 cooperates with the feed head 102 and the take away rolls 110 to vary the speed of the sheet in the telescopic baffle 114 so that the time period from feeding the sheet from the top of the stack 130 to the acquisition rolls 150 remains constant no matter what the length of the sheetpath through the baffle guide 114 to the acquisition rolls 150.

Of course, it would be apparent to those familiar with the art that a modified vertical transport, preferable a vacuum transport, could be utilized having a multiple acquisition station to receive sheets from the feed head. The vertical transport would then have to be variable speed so that the sheets fed from the feed head to the acquisition rolls would arrive at the acquisition rolls within a constant time period.

The feed head relies on gravity to lower the feeder and upon necessitating a reload of paper into the machine, the feed head is coupled to the door mechanism 162 so that when the door 160 to the paper tray is open, the feed head is vertically retracted to allow for replenishing of the sheet stack. Of course, the feedhead could also be driven down in response to paper utilization, and up when the door is opened. This floating feed head design provides for the elimination of a paper elevator and the relatively high power required to drive a fully loaded elevator stack to a fixed position feed head.

While the invention herein has been described in the context of a high capacity sheet feeder it will be readily apparent that the transport can be utilized in any sheet feeding situation which requires sheets to be delivered in a timed relationship.

In recapitulation, there is provided a floating feedhead having a variable sheetpath for an electrophotographic printing machine. A floating feeder with a variable speed variable length sheetpath for feeding sheets from the top of a stack to a processor for a printing machine is disclosed. The feedhead is on a standard retard feed type having either a nudger roll/feed roll or a feed belt in combination with a retard member to separate sheets. The feedhead is connected to the sheet delivery area of the machine by a variable length, variable speed sheetpath. The sheetpath has a drive member such as a drive nip in cooperation with the feedhead. When the sheetpath is at its longest the feedhead and variable drive member operate at a higher speed to deliver the sheets to the sheet intake area at a predetermined time interval. As sheets are fed and the sheetpath becomes shorter, the variable drive and feedhead slow to maintain proper sheet timing. The sheetpath may be of a telescopic baffle configuration or could alternatively be a variable speed vertical transport arrangement.

It is, therefore, apparent that there has been provided in accordance with the present invention, a high productivity trayless duplex loop that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic printing machine having a sheet feeding apparatus for feeding cut sheets in timed relationship into a sheet processor, comprising:

a fixed support for supporting a stack of sheets;

a movable feedhead contacting the stack of sheets; and a variable length sheetpath between said feedhead and a sheet delivery area, further comprising a variable speed drive for feeding sheets through said variable length sheetpath to said sheet delivery area.

2. A sheet feeding apparatus, comprising:

a fixed support for supporting a stack of sheets;

a movable feedhead contacting the stack of sheets; and a variable length sheetpath between said feedhead and a sheet delivery area, further comprising a variable speed drive for feeding sheets through said variable length sheetpath to said sheet delivery area.

* * * * *